US009134027B2

(12) United States Patent
Wiles et al.

(10) Patent No.: US 9,134,027 B2
(45) Date of Patent: Sep. 15, 2015

(54) AIR FIRE LIGHTER

(71) Applicant: INFORA, LLC, Pine Island, NY (US)

(72) Inventors: StJohn Wiles, Pine Island, NY (US); Pia Wiles, Pine Island, NY (US); Vaughan Wiles, Warwick, NY (US)

( * ) Notice: Subject to any disclaimer, the term of this patent is extended or adjusted under 35 U.S.C. 154(b) by 0 days.

(21) Appl. No.: 14/479,452

(22) Filed: Sep. 8, 2014

(65) Prior Publication Data

US 2014/0377710 A1 Dec. 25, 2014

Related U.S. Application Data

(63) Continuation of application No. 14/082,517, filed on Nov. 18, 2013, now Pat. No. 8,851,885.

(60) Provisional application No. 61/729,809, filed on Nov. 26, 2012.

(51) Int. Cl.

| | |
|---|---|
| ***F23Q 2/16*** | (2006.01) |
| ***F23Q 2/34*** | (2006.01) |
| ***F23Q 2/28*** | (2006.01) |
| ***F23Q 3/00*** | (2006.01) |
| ***F23Q 7/04*** | (2006.01) |

(52) U.S. Cl.

CPC *F23Q 2/34* (2013.01); *F23Q 2/285* (2013.01); *F23Q 3/008* (2013.01); *F23Q 7/04* (2013.01); *Y10T 29/49826* (2015.01)

(58) Field of Classification Search

CPC ..... A47J 37/09; F23Q 2/16

USPC ..... 431/255, 254, 6, 72; 126/25 B

See application file for complete search history.

(56) References Cited

U.S. PATENT DOCUMENTS

| | | | | |
|---|---|---|---|---|
| 1,977,151 | A | 10/1934 | Schottky | |
| 2,192,732 | A | 3/1940 | Johnson | |
| 2,666,480 | A * | 1/1954 | Peterson | 431/255 |
| 2,963,081 | A | 12/1960 | Roy | |
| 3,009,803 | A | 11/1961 | Damon et. al. | |
| 3,334,214 | A | 8/1967 | Davidson | |
| 3,576,471 | A | 4/1971 | Schumacher | |
| 4,190,034 | A | 2/1980 | Wonisch | |
| 4,901,196 | A | 2/1990 | Grzybowski | |
| 5,545,035 | A | 8/1996 | Tsai | |
| 6,012,916 | A | 1/2000 | Liang | |
| 7,717,104 | B2 | 5/2010 | Looft | |
| 2007/0044784 | A1 | 3/2007 | Thompson | |
| 2007/0160945 | A1 | 7/2007 | Lin | |
| 2009/0148801 | A1 | 6/2009 | Wedermann | |
| 2010/0083946 | A1 | 4/2010 | Cedar et al. | |
| 2013/0177859 | A1 * | 7/2013 | Prior et al. | 431/12 |

* cited by examiner

FOREIGN PATENT DOCUMENTS

| | | | |
|---|---|---|---|
| DE | 102005048058 | A1 | 4/2007 |
| DE | 102007043700 | A1 | 3/2009 |
| EP | 2375159 | A1 | 10/2011 |

*Primary Examiner* — Avinash Savani

(74) *Attorney, Agent, or Firm* — Werschulz Patent Law, LLC

(57) ABSTRACT

An air fire lighter having fuel, an igniter and a ducted fan for igniting a solid fuel fire. The fuel travels through the fire lighter to a collar at a distal end of the fire lighter, transforming into a vapor that is ignited by an igniter. As the solid fuel begins to glow at the initiation of the fire, the fan is activated, shutting off the vapors from the fuel. The fan blows air through a chamber onto the fire, causing the fire to spread throughout the solid fuel, establishing and spreading the fire through an ignition period. The chamber has a volume and ducting for providing optimal airflow to the fire. The fan is battery-operated. The lighter is lightweight and compact with a swiveling handle that adjusts for optimal placement of the lighter for addressing the solid fuel, folding for portability and storage.

10 Claims, 5 Drawing Sheets

AIR FIRE LIGHTER

CROSS-REFERENCE TO RELATED APPLICATIONS

This application is a continuation utility application of the nonprovisional utility patent application, Ser. No. 14/082,517, filed in the United States Patent Office on Nov. 18, 2013, that claimed priority to the provisional patent application, Ser. No. 61/729,809, filed in the United States Patent Office on Nov. 26, 2012 and claims the priority thereof and is expressly incorporated herein by reference in its entirety.

TECHNICAL FIELD

The present disclosure relates generally to a fire lighter. More particularly, the present disclosure relates to air fire lighter for starting a solid fuel fire.

BACKGROUND

Since cave dweller days, lighting a fire in a safe, efficient and rapid manner is desired by all who seek a fire for heating and cooking. No longer is rubbing two sticks together or striking a flint to spark a fire considered as anything but a last resort.

Many devices on the market are available to start a solid fuel fire such as a campfire, a charcoal grill, fireplace or chimenea that burn charcoal or wood. Some are simply long matches, cigarette lighters with a long tip or a glowing wire powered by electricity.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a portable fire lighter. Accordingly, the present disclosure provides a fire lighter device that is battery-operated, lightweight and compact with a swiveling handle that folds in towards a housing for easy portability and storage and further adjusts into a plurality of positions forming a wand, a pistol grip or positions therebetween for optimal placement of the lighter in relation to solid fuel.

Another aspect of an example embodiment in the present disclosure is to provide a convenient fire lighter. Accordingly, the present disclosure provides a fire lighting device that operates without an external power source, useable anywhere without requiring a connection to electrical power.

A further aspect of an example embodiment in the present disclosure is to provide a safe fire lighter for lighting a solid fuel fire that isolates gaseous fuel from an operating electrical fan. Accordingly, the present disclosure provides a device that closes off fuel when the fan is activated once the solid fuel is glowing.

Yet a further aspect of an example embodiment in the present disclosure is to provide a fire lighter with a gaseous fuel for lighting a solid fuel fire. Accordingly, the present disclosure provides a chamber with a conduit coupling a liquid fuel reservoir to a collar distal to the reservoir, the conduit transporting the fuel to the collar where it is ignited into a flame and the flame applied to the solid fuel.

Yet another aspect of an example embodiment in the present disclosure is to provide a fire lighter that blows air for establishing and spreading a fire after initial ignition. Accordingly, the present disclosure provides a fire lighter with a fan in a chamber, the chamber having ducting and a volume that provides optimal airflow to the fire for establishing and spreading the fire after an initial glowing stage through the solid fuel.

The present disclosure describes an air fire lighter having fuel, an igniter and a ducted fan for igniting a solid fuel fire. The fuel in a gaseous state travels through the fire lighter to a collar at a distal end of the fire lighter, and is ignited by the igniter. As the solid fuel begins to glow at the initiation of the fire, the fan is activated, shutting off the vapors from the fuel. The fan blows air through a chamber onto the fire, causing the fire to spread throughout the solid fuel, establishing and spreading the fire. The chamber has a volume and ducting for providing optimal airflow to the fire. The fan is battery-operated. The lighter is lightweight and compact with a swiveling handle that adjusts into a plurality of positions forming a wand, a pistol grip or positions therebetween for optimal placement of the lighter in relation to solid fuel and folds easy portability and storage.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
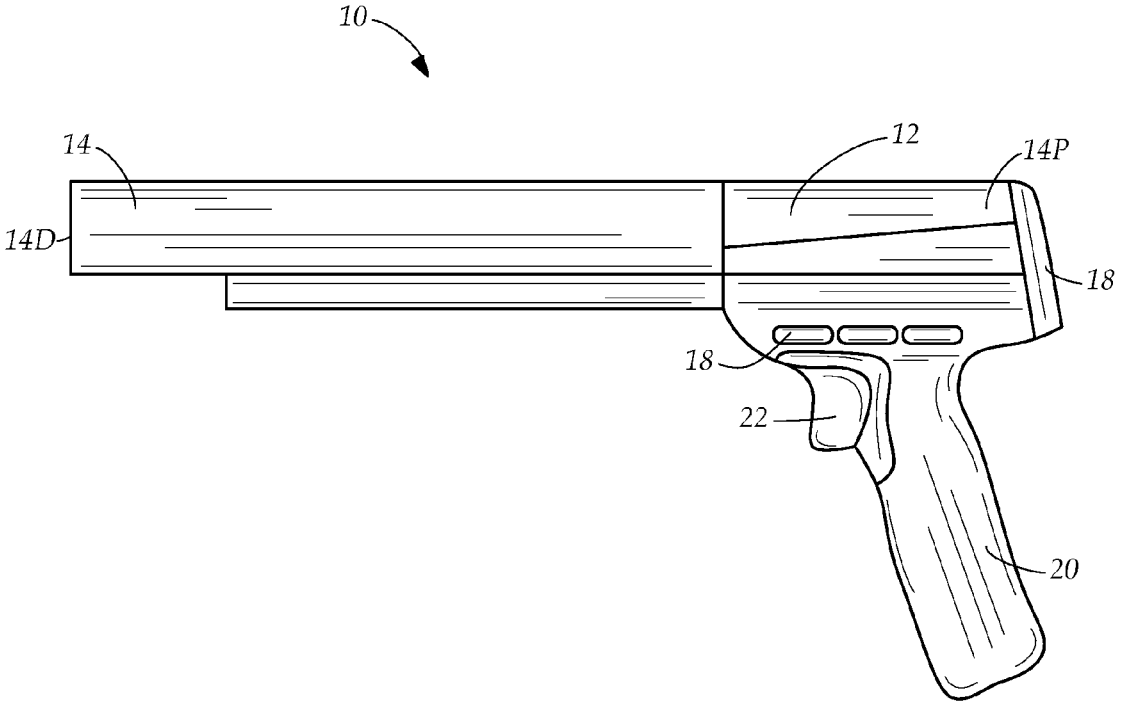
FIG. 1 is a side elevational view of a fire lighter.

FIG. 1 illustrates an air fire lighter 10 for starting a solid fuel fire. The air fire lighter initiates a fire by heating solid fuel with a lighter flame until combustion begins and a glow point forms in the fuel. The air fire lighter spreads the fire by blowing air on the glow point, distributing the heat and combustible vapors released by the solid fuel at a glow point stage to adjacent solid fuel until a persistent combustion stage is established, forming a vibrant flame that is further spread by the blowing air. The solid fuel is, for example, but not limited to, wood, charcoal, peat, coal, biomass pellets and other similar combustibles that burn producing heat and light. The solid fuel is burnt, for example, but not limited to, in an open campfire, a stove, a grill, a fireplace, a chimenea, a fire pit and a smoker.

Figure 3:
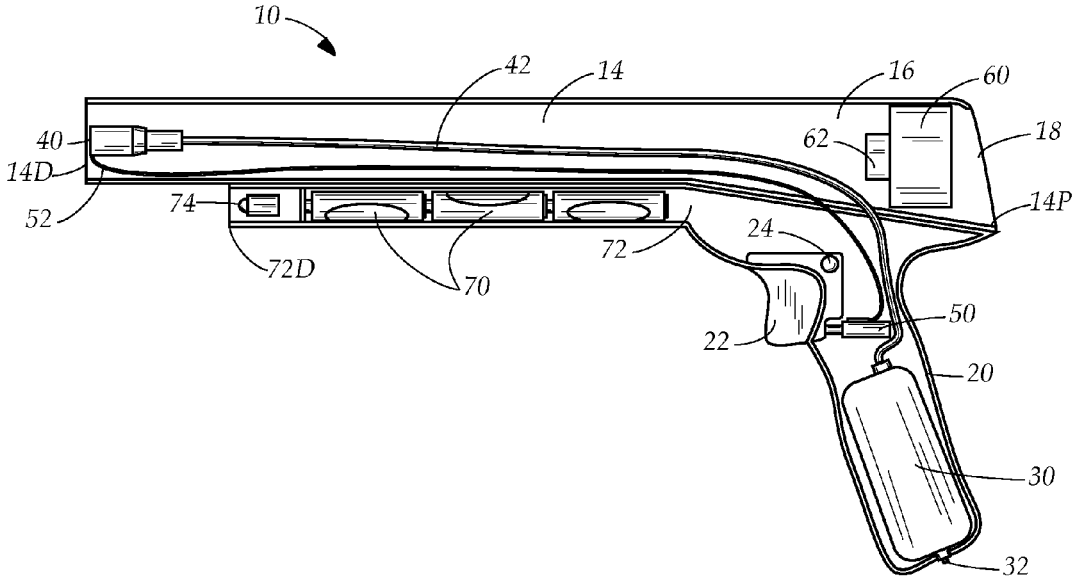
FIG. 3 is a cross-section side view of the fire lighter.

The air fire lighter 10 has a housing 12 and the housing has a barrel 14 with a distal end 14D and a proximal end 14P. The barrel has an internal chamber described hereinbelow. The housing has a plurality of air ducts 18 admitting air into the chamber from the ambient air surrounding the lighter. The housing has a grip 20 coupled to the barrel at the proximal end 14P. The lighter flame is produced at the distal end of the barrel 14D. FIG. 3 illustrates the fire lighter in cross-section from a side view perspective of the housing 12. Inside the housing is a fuel module. The fuel module has a liquid fuel in a reservoir 30, the reservoir in the grip 20. The fuel is vaporized in the reservoir. The fuel module has a burner collar 40 at the distal end 14D of the barrel. A conduit 42 couples the reservoir 30 and the collar 40 operative for transporting the gaseous fuel from the reservoir to the collar, the conduit 42 operative for mixing air with the gaseous fuel through an opening before the fuel presents at the collar 40.

The lighter has an igniter module having an igniter 50 at the distal end 14D of the barrel adjacent to the collar 40. In one embodiment, the igniter is a piezo igniter. In a further embodiment, the igniter is an automatic igniter that electrically generates a spark. The igniter module has a switching means. In the illustrated example embodiment shown in FIG. 3, the igniter module has a trigger 22 on the grip 20 for initiating the lighter flame. The trigger when activated, is operative for opening the reservoir 30 to the conduit 42, allowing the gaseous fuel to flow to the collar 40, the trigger operative for generating a spark from the igniter 50, the spark igniting the gaseous fuel at the collar 40 producing the lighter flame operative for starting the solid fuel fire to a glow point stage. The igniter is coupled to the collar 40 by a conducting wire 52, the electrical discharge of the igniter 50 traveling along the wire to the collar 40 producing the spark. Piezo ignition and automatic ignition by electrically generated spark are well known to those of ordinary skills and more detailed discussion is beyond the scope of this disclosure.

The trigger 22 has a safety switch 24 for compliance with safety standards. The trigger has a continuous button for operating the flame continuously locking the trigger in an operating position. The button is not shown.

In another example embodiment, which is not shown, a sliding switch slides in one direction for opening the reservoir and generating the spark as explained hereinabove and slides in an opposite direction operative for activating a fan as explained hereinbelow.

A battery-operated fan 60 is inside the chamber 16, the fan activated after the fire is at the glow point stage. In the figure illustrating the example embodiment, the fan is an axial fan. Activating the fan 60 closes off the liquid reservoir 30 to the conduit 42. The fan is operative for establishing and spreading the fire throughout the solid fuel as described hereinabove, the fan blowing air through the chamber 16 and out the distal end 14D of the barrel onto the solid fuel fire, the air stimulating the fire to the persistent combustion stage as explained hereinabove.

The chamber 16 inside the barrel 14 has a length around 30 centimeters and an internal diameter of around 3.5 centimeters. In the illustrated example embodiment, the axis 62 of the fan is centered in the chamber and parallel to the barrel 14, creating a pressure chamber but other configurations are possible within the inventive concept, the fan creating the pressure chamber from any angle. The fan has a plurality of air flow flanges that are not shown. Airflow is significantly affected by the design of the fan and housing, and the length and diameter of the barrel. Appropriate ducting of the fan assists in the best flow of air for delivering the most effective volume and airflow.

In one example embodiment, the ducts 18 are behind the fan 60 at the proximal end of the barrel. In another example embodiment, the ducts are in the chamber downstream to the fan. FIG. 1 shows an approximation of the duct location on the barrel 14 in the example embodiment where the ducts are upstream to the fan.

Figure 2:
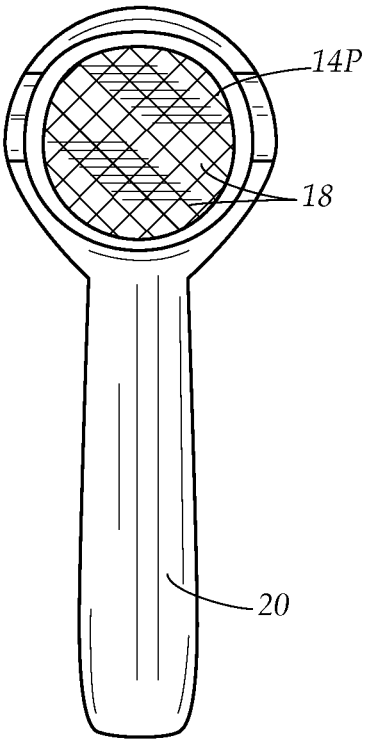
FIG. 2 is a rear elevational view of the fire lighter.

Referring to FIG. 2, the proximal end of the barrel and the grip 20 is shown. The proximal end of the barrel has the plurality of ducts 18 upstream of the fan.

Referring again to FIG. 3, the fan 60 is activated by a switch, the switch operative for turning the fan on and simultaneously closing off the liquid reservoir 30 to the conduit 42. As explained hereinabove, the switch can also toggle the igniter module.

The lighter 10 has a plurality of rechargeable batteries 70 coupled to the fan 60 operative for powering the fan. The lighter does not require any other power source, such as AC current so that the lighter is easily portable. The batteries are in a chamber 72 in the housing, however, the placement of the batteries within the housing is not a limitation. In one embodiment, the batteries supply power for the automatic igniter that electrically produces the ignition spark.

In one example embodiment, an LED (light emitting diode) flashlight 74 operative for guiding the distal end of the barrel during fire starting is coupled to the housing adjacent to the distal end of the barrel. In a further example embodiment, the second chamber 72 has a distal end 72D with the LED flashlight 74 operative for guiding the distal end 14D of the barrel during fire lighting, the LED flashlight selectively actuated by a switch which is not shown. The batteries 70 are coupled to the flashlight operative for powering the flashlight 74.

In a further example embodiment, which is not shown, a bottle opener is coupled to the housing, the bottle opener operative for opening bottles and hanging the lighter on hook for storage.

In one example embodiment, the reservoir is selectively refillable through a valve on the grip 20. The fuel is, for example, but not limited to, butane, but other flammable liquids such a mixture of low molecular weight hydrocarbons and alcohols typically used in charcoal lighter fluid are suitable for an example embodiment of the lighter.

Figure 5A:
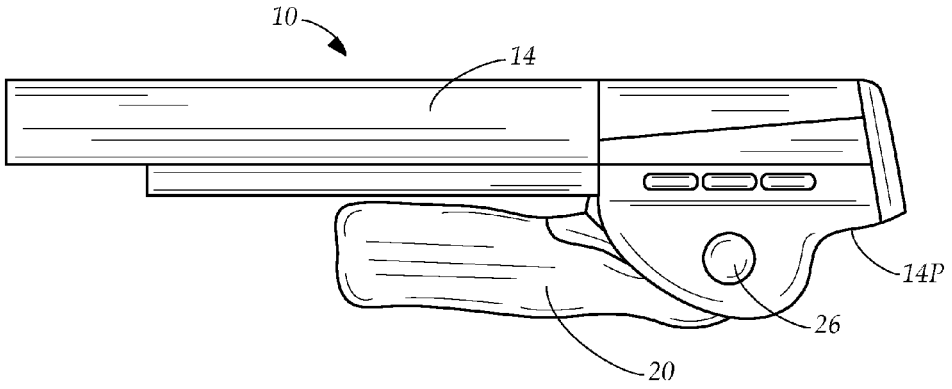
FIG. 5A is a side elevational view of the fire lighter with a handle folded for storage.
Figure 5B:
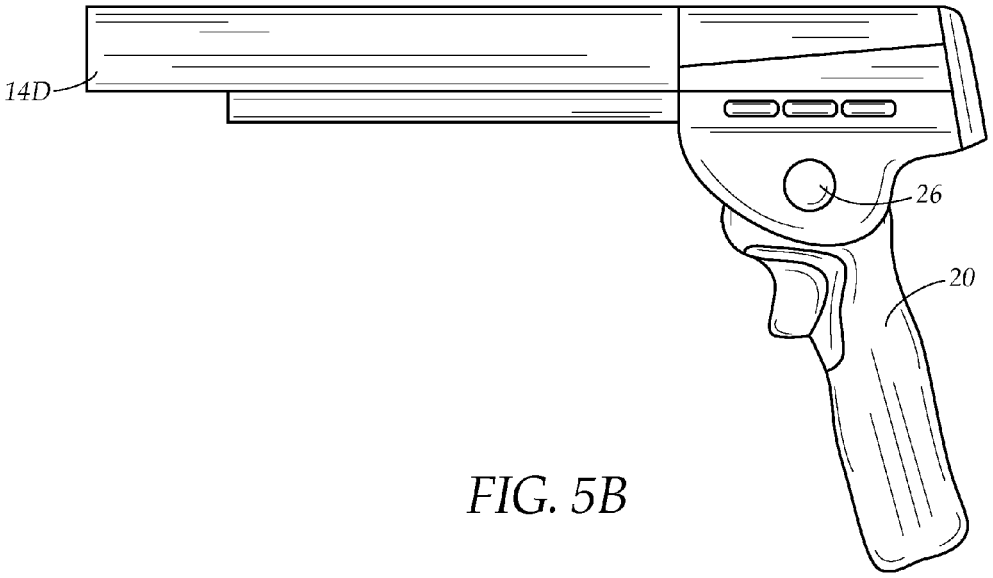
FIG. 5B, similar to FIG. 5A, is a side elevational view of the fire lighter with the handle extended for use.

FIG. 5A shows one example embodiment of the lighter 10 wherein the grip 20 is hingedly attached to the proximal end 14P of the barrel, the grip swiveling around a hinge 26 to a position parallel to the barrel 14 operative for compact storage. In FIG. 5B, the grip swivels around the hinge to a plurality of positions operative for accurately pointing the distal end 14D of the barrel 14 at the solid fuel, the barrel addressing the fuel from a plurality of angles. The grip forms a plurality of positions, forming a wand, a pistol grip or positions therebetween for optimal placement of the lighter when addressing the solid fuel.

Figure 4:
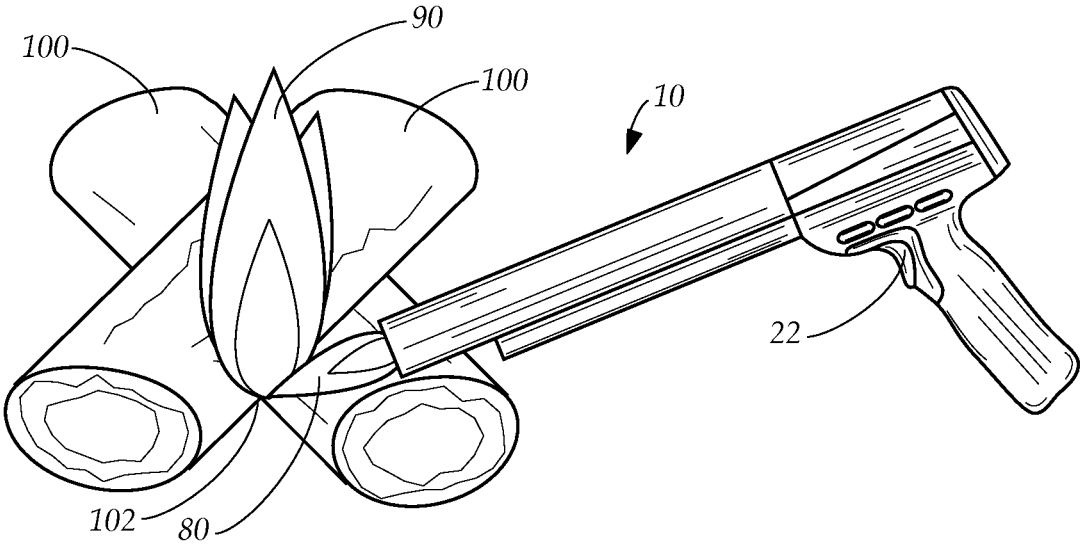
FIG. 4 is a perspective view of the fire lighter lighting a solid fuel fire.

A method of using an air fire lighter to start a solid fuel fire is illustrated in FIG. 4. A plurality of solid fuel pieces 100 are arranged, the pieces of solid fuel in contact with each other.

A flame 80 is triggered to ignite a fire 90 by pulling a trigger 22 on the air fire lighter 10. As shown in FIG. 3, the trigger 22 is operative for opening the fuel reservoir 30 to a conduit 42, allowing the fuel to flow to the collar 40, the trigger operative for generating a spark from the igniter 50, the spark igniting the gaseous fuel at the collar producing the flame operative for starting the solid fuel fire to a glowing stage.

Referring back to FIG. 4, the flame 80 of the lighter is pointed at the solid fuel pieces 100 applying the flame directly to the solid fuel, continuously engaging the trigger 22.

Referring back to FIG. 3, when the fire is at the glow point stage, the fan 60 is activated inside the chamber 16 in the fire lighter, activating the fan simultaneously closes off the liquid reservoir 30 to the conduit 42, the fan operative for establishing and spreading the fire throughout the solid fuel, the fan 60 blowing air through the chamber 16 and onto the solid fuel fire, the air stimulating the fire to a combustion stage.

Referring again to FIG. 4, the lighter flame 80 is applied directly to the solid fuel 100 for 20 seconds to 60 seconds before activating the fan. The fan blows air through the chamber and onto the solid fuel for around two minutes on a single spot 102. In one example embodiment, the fire is being prepared for cooking and the fan selectively blows air for an additional five minutes on the fire in the burning stage operative for spreading the fire 90 throughout the pieces of solid fuel 100 to quickly bring the fire up to a cooking temperature.

In another example embodiment, the step of triggering a flame 80 by pulling a trigger on the air fire lighter 10 is preceded by the step of releasing a safety switch on the trigger 22.

In a further example embodiment, the step of applying the flame 80 directly to the solid fuel 100 for around 20 seconds is followed by the step of selectively engaging a continuous button (which is not shown in the drawing) on the trigger 22 to apply the flame 80 directly to the solid fuel locking the trigger into an engaged position.

A method of manufacturing an air fire lighter is shown in FIG. 3. The fuel module having a liquid fuel reservoir 30 is coupled to the housing 12 having the barrel 14 with the distal end 14D, the proximal end 14P and the grip 20 hingedly coupled to the barrel 14 at the proximal end 14P, the reservoir operative for storing liquid fuel. The fuel module having a burner collar 40 is further coupled to the housing 12, the collar 40 at the distal end 14D of the barrel. The conduit 42 within the housing 12 operative for transporting the fuel from the reservoir 30 to the collar 40.

The igniter module is coupled to the housing 12 and the fuel module. The igniter module has an igniter 50 at the distal end 14D of the barrel adjacent to the collar 40, the igniter module has a trigger 22 on the grip 20, the trigger operative for opening the reservoir 30 to the conduit 42, the trigger operative for generating a spark from the igniter 50.

The fan 60 is coupled to the housing 12, the fan having a switch and the shaft 62, the switch operative for activating the fan and closing off the liquid reservoir to the conduit. In one example embodiment, the fan 60 is within the chamber 16, the shaft 62 of the fan axially parallel to the barrel 14, the fan 60 operative for blowing air through the chamber 16 and out the barrel 14.

Coupling the fan 60 to the housing 12 includes operationally coupling a plurality of batteries 70 within the housing 12 to the fan 60.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an air fire lighter. The disclosure is illustrated by example in the drawing figures, and throughout the written description. It should be understood that numerous variations are possible, while adhering to the inventive concept. Such variations are contemplated as being a part of the present disclosure.

What is claimed is:

1. An air fire lighter for starting a solid fuel fire, comprising:

a housing having a barrel with a distal end and a proximal end, the barrel having an internal chamber, the housing having at least one air duct in fluid communication with ambient air, admitting air into said chamber from ambient air surrounding the lighter;

a fuel module, the fuel module having a liquid fuel in a reservoir inside the housing at the proximal end, the fuel module having a burner collar, the collar at the distal end of the barrel, the fuel module having a conduit operative for transporting the liquid fuel from the reservoir to the collar, the liquid fuel vaporizing such that the fuel is gaseous at the collar;

an igniter module, the igniter module having an igniter at the distal end of the barrel adjacent to the burner collar, the igniter module having at least one trigger on the housing, the at least one trigger operative for opening the reservoir to the conduit, allowing the fuel to flow to the collar, the at least one trigger when activated operative for generating a spark from the igniter, the spark igniting the gaseous fuel at the collar producing a flame, the flame operative for starting a solid fuel fire and stimulating the flame to glowing stage in the solid fuel; and a battery-operated fan having a rotation axis centered inside the chamber parallel to the barrel, the fan activated after the flame is at a glowing stage, the fan activated by a switch, the switch operative for turning the fan on and simultaneously closing off the liquid reservoir to the conduit, the fan operative for establishing and spreading the flame throughout the solid fuel, the fan blowing air through the chamber and out the barrel onto the solid fuel, the air stimulating the flame to a burning stage fire.

2. The air fire lighter as described in claim 1, wherein the switch is a sliding switch, the switch selectively sliding in a first direction operative for opening the reservoir to the conduit and selectively sliding in a second direction operative for closing off the liquid reservoir to the conduit and activating the fan.

3. The air lighter as described in claim 1, wherein the at least one is a pair of triggers, a first trigger operative for opening the reservoir to the conduit and a second trigger operative for generating a spark from the igniter.

4. The air fire lighter as described in claim 1, wherein the at least one air duct is upstream behind the fan at the proximal end of the barrel.

5. The air fire lighter as described in claim 1, wherein the at least one air duct is downstream to the fan in the chamber.

6. The air fire lighter as described in claim 1, wherein the fan is an axial fan having the rotation axis centered in the chamber and parallel to the barrel, the fan having flanges, the fan configured for creating an air pressure chamber within the housing.

7. The air fire lighter as described in claim 1, wherein the at least one trigger has a safety switch.

8. The air fire lighter as described in claim 7, wherein the at least one trigger has a continuous button for operating the flame continuously, locking the at least one trigger in an engaged position, maintaining the opening of the conduit.

9. A method of using the air fire lighter to start a solid fuel fire, comprising:

releasing a safety switch on at least one trigger on an air fire lighter, enabling the at least one trigger to open a conduit in the air fire lighter to a fuel reservoir in the air fire lighter containing liquid fuel, allowing the fuel to flow through said conduit to a burner collar at a distal end of the air fire lighter, the fuel gaseous at the burner collar;

triggering a flame to ignite a fire by pulling the at least one trigger on an air fire lighter, the at least one trigger operative for generating a spark from an igniter at a distal end of the air fire lighter, the spark igniting the fuel at the burner collar producing the flame operative for starting a solid fuel fire to a glowing stage;

pointing the flame at a plurality of solid fuel pieces where at least two pieces are in contact with each other, applying the flame directly to the solid fuel pieces, continuously engaging the at least one trigger, stimulating the flame to a glowing stage by distributing the heat and combustible vapors released by the solid fuel pieces; and activating an axial fan having an axis centered inside a chamber in the fire lighter parallel to a barrel of the fire lighter, activating the fan simultaneously closing off the liquid reservoir to the conduit, the fan operative for establishing and spreading the fire throughout the solid fuel, the fan blowing air through the chamber and onto the solid fuel fire, the air stimulating the fire to a burning stage.

10. The method of using the air fire lighter as described in claim 9, wherein the at least one is a pair of triggers, a first trigger operative for opening the reservoir to the conduit and a second trigger operative for generating a spark from the igniter.

* * * * *